United States Patent [19]

Smith

[11] Patent Number: 4,980,939

[45] Date of Patent: Jan. 1, 1991

[54] WATER FILLED CUSHION

[76] Inventor: Peter A. Smith, C/- Smith & Co., 593-595 Princes Highway, Rockdale, New South Wales, 2216, Australia

[21] Appl. No.: 511,942

[22] Filed: Apr. 16, 1990

Related U.S. Application Data

[63] Continuation of Ser. No. 364,482, Jun. 8, 1989, abandoned, which is a continuation of Ser. No. 243,604, Sep. 13, 1988, abandoned.

[51] Int. Cl.[5] ..... A47C 27/08

[52] U.S. Cl. ..... 5/451; 5/466; 190/1; 383/4

[58] Field of Search ..... 5/451, 450, 441, 449, 5/455, 442, 466, 481; 383/4; 190/1; 297/DIG. 1, DIG. 3

[56] References Cited

U.S. PATENT DOCUMENTS

| | | | |
|---|---|---|---|
| 2,618,790 | 11/1952 | Ritchey | 5/442 |
| 3,663,973 | 5/1972 | Spence | 5/450 |
| 3,702,484 | 11/1972 | Tobinick et al. | 5/451 |
| 3,737,930 | 6/1973 | Smith | 5/450 |
| 4,671,393 | 6/1987 | Rainey | 190/1 |
| 4,723,300 | 2/1988 | Aranow | 190/1 |

FOREIGN PATENT DOCUMENTS

| | | | |
|---|---|---|---|
| 1594111 | 7/1981 | United Kingdom | 5/450 |

OTHER PUBLICATIONS

"Lotus" A trade brochure about Cushion No. WC1517 available from 31 Sheridan Drive, Naugatuck, Conn. 06770, 1/1982.

*Primary Examiner*—Alexander Grosz

*Attorney, Agent, or Firm*—Oblon, Spivak, McClelland, Maier & Neustadt

[57] ABSTRACT

A cushion dimensioned to support a seated user is comprised of an outer covering with handles defined by a continuous strap attached to the outer covering. A foam cushion layer is permanently attached to the outer covering and a liquid filled pouch is slideably enclosed by the outer covering.

3 Claims, 3 Drawing Sheets

WATER FILLED CUSHION

This application is a continuation of application Ser. No. 07/364,482 filed on June 8, 1989, abandoned, which is a continuation application of Ser. No. 07/243,604, filed Sept. 13, 1988, abandoned.

BACKGROUND OF THE INVENTION

This invention relates to a cushion which uses water as its principal supporting medium.

The cushion has been developed primarily as a seat cushion for use by a paraplegic or quadriplegic who is confined to a wheelchair. However, the cushion does have broader application and it may be employed for supporting any anatomical part of a person who is confined to a bed or chair for protracted periods of time and who might suffer discomfort from pressure points which are experienced with use of more conventional support cushions.

SUMMARY OF THE INVENTION

Broadly defined, the invention provides a cushion which comprises a pouch which is formed from a flexible liquid impervious material and which normally is filled with a liquid. A pad of resiliently compressible material extends over at least one surface of the pouch, and a flexible material covering envelopes both the pouch and the pad. Preferably, the liquid is water.

The water pouch may also contain a motion stabilizing additive such as polymeric granules which absorb water or an agent which increases the viscosity of the water. The motion stabilizing additive acts to stabilize (or minimise the movement of) the seating surface and provides improved support with less water which, of course, leads to a cushion of less weight.

The cushion preferably has handles connected to the covering, so that the cushion may be picked up and be carried from place to place. This is an important requirement in the case of cushions which are intended for wheelchairs which may be folded or stowed for transport. The handles preferably are formed as extensions of straps which extend across the undersurface of the cushion, so that, when picked up by the handles, the cushion folds against itself with the straps surrounding and carrying the mass of water in the cushion. A zipper or other fastener may be provided to secure the edges of the cushion together to form a neat package.

The pad of resiliently compressible material would normally be located on the upper surface of the pouch, to form a load distributing barrier between the pouch and a person supported by the cushion. The pad most preferably is formed from a panel of soft foam material of a type which conventionally is used in upholstered chairs.

The cushion covering would normally be formed from a soft fabric-like material, such as is employed for covering conventional chairs, but where the cushion is intended to be used by an incontinent person, the cover may be formed from a water impervious material.

The pouch would normally be fitted with a stoppered opening to permit water to be poured into and from the pouch as and when required. Water in an amount required to meet the needs of an individual user is poured into the pouch and all remaining air is then excluded before closing the pouch with the stopper. The covering preferably is fitted with a zipper or stud fasteners to permit convenient access to be gained to the pouch filler opening.

BRIEF DESCRIPTION OF THE DRAWINGS

The invention will be more fully understood from the following description of a preferred embodiment of a cushion which is illustrated in the accompanying drawings. In the drawings.

DESCRIPTION OF THE PREFERRED EMBODIMENT

Figure 1:
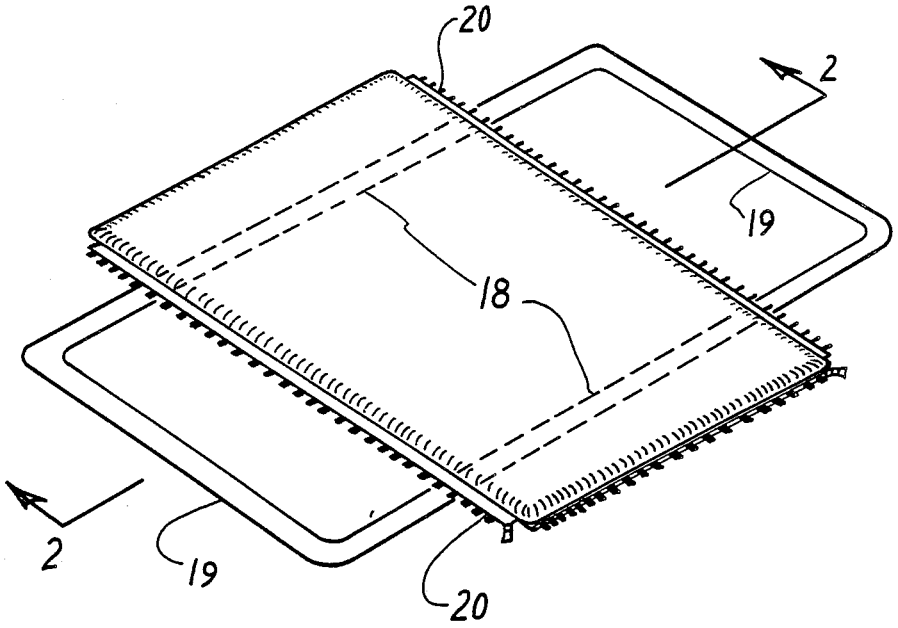
FIG. 1 is a perspective view of the cushion when in a normal, flat position.

As illustrated in the drawings, the cushion comprises a pouch or water bag 10 which is formed from a strong, water-impervious plastics sheet material. The pouch may be collapsed for stowage but it would normally be filled with water 11 and, when so filled the pouch assumes a generally oblong shape. A threaded filler neck 12 is welded into an upper wall 13 of the water bag 10 and a screw cap 14 is provided for closing the neck 12 after water has been poured into the water bag 10.

A pad 15 of resiliently compressible foamed plastics material covers the upper surface of the pouch 10, and a covering 16 which is formed from a woven fabric envelopes both the water bag 10 and the pad 15. The pad 15 may be sewn or adhered to the inside of the covering 16, but the water bag 10 is removable from the covering.

It is preferred that the water bag 10 has a volume when filled which is slightly less than the volume of the space that the pouch occupies in the covering 16 to allow some adjustment of the water bag 10 within the covering 16. It is also desirable that, when the pouch is contained within the covering and is filled with water, it should not be stressed to any significant extent.

Thus, when the water bag 10 is contained by the cushion it can be expanded to its full volume by the contents and in doing so will not allow any creases that may occur during transport or storage to remain in place, for the displacement of the contents when the cushion is used will extend the water bag to its potential volume and will eliminate creasing that may have occurred.

A zip fastener 17 extends around a major portion of two sides of the covering 16, so that the water bag 10 may be removed or in order to permit filling of the water bag 10 with water.

Figure 4:
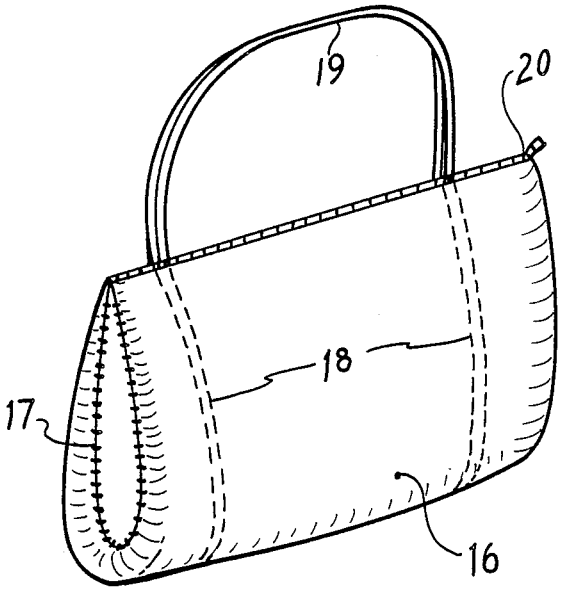
FIG. 4 is an end elevation view of the cushion when in a folded condition, and, FIG. 5 is a cutaway, simplified view similar to FIG. 2.
Figure 5:
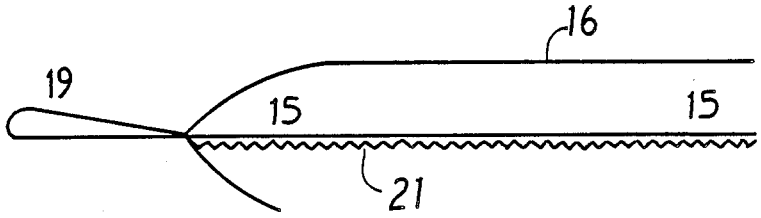

Two web-type straps 18 extend across the underside of the cushion and are sewn or otherwise attached to the covering 16. The straps extend beyond the edges of the cushion and are looped to form handles 19 which may be used to carry the cushion. When picked up and carried by the handles, the cushion folds against itself as shown in FIG. 4, and the straps extend right around the cushion to fully support the mass of water which is carried in the pouch 10.

Figure 2:
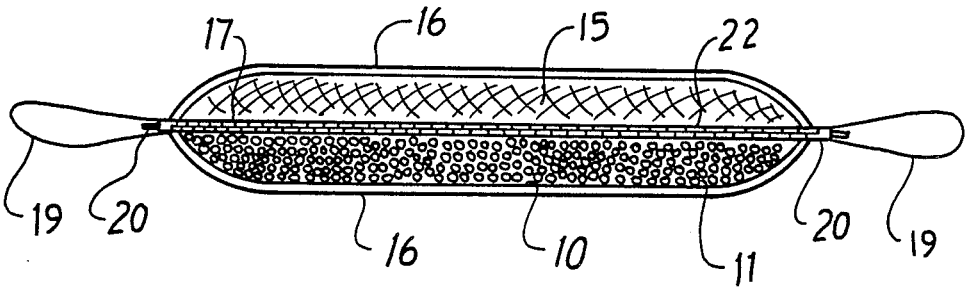
FIG. 2 is a sectional view of the cushion, as taken in the direction of arrows 2-2 shown in FIG. 1.
Figure 3:
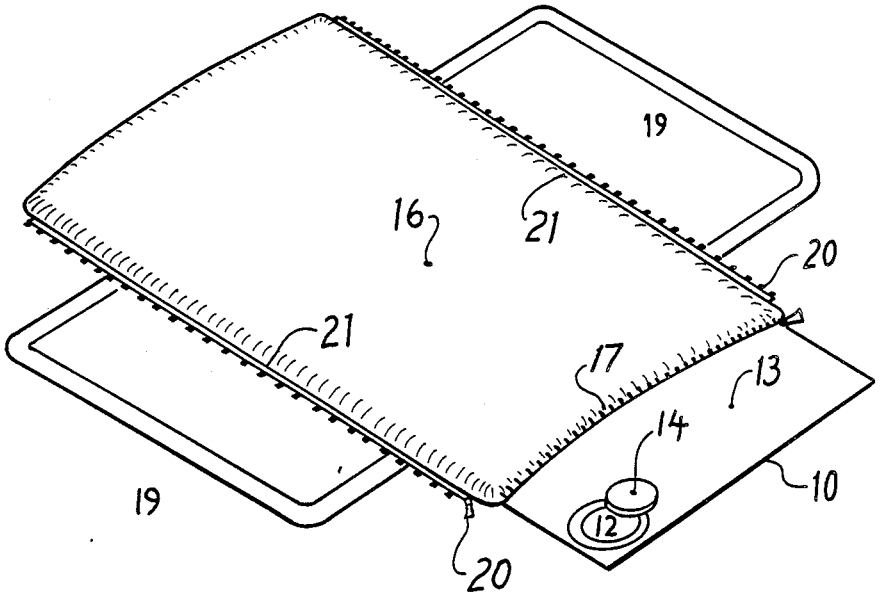
FIG. 3 is a perspective view of the cushion with its covering removed and a water fill opening exposed.

A zipper 20 extends along the edges 21 of the covering 16 so that the cushion may be formed into a neat package for carrying. Other fasteners such as press studs or tie strings could be used instead of the zippers 17 and 20. As can be seen in FIG. 2, the water bag 10 may be covered by a plastic liner 22.

In a preferred form of the invention, the water pouch 10 also contains a motion stabilizing additive which acts to minimise the movement of the seating surface and provides improved support with minimum water content.

The additive may be the so-called water crystals sold under the trade mark AQUALINK. These polymeric crystals absorb up to 200 times their volume of water to form a stable fluid bed. A viscous liquid such as a gel or starch based or glucose based solution could be used instead of the water and water crystal combination.

An added benefit of the stabilizing additive is that the minimum amount of liquid is lost should the water bag 10 be punctured or should a seam fault arise.

Variations and modifications may be made in respect of the cushion as above described without departing from the scope of the invention as defined in the appended claims.

I claim:

1. A portable cushion assembly dimensioned to support a seated user, which comprises:

a woven fabric outer covering which is adapted to permanently enclose a first cushion layer comprising a resiliently compressible foamed plastic material and to slideably enclose a second cushion layer which comprises a generally planar, refillable, liquid filled pouch;

said first and second layers being of generally the same shape and volume and being enclosed and urged into meeting relationship along a common plane by said outer covering; a user of said cushion being seatable on a surface of said cushion which is parallel with said common plane and on an opposite side of said common plane to said fluid filled pouch; said cushion further including a continuous strap formed into a closed shape connected to said outer covering;

at least part of said strap protruding beyond two opposed ends of said cushion whereby said strap can be used as a carry handle for said cushion assembly when said cushion assembly when said cushion assembly is folded so as to cause those portions of said strap protruding beyond said two opposed ends of said cushion to meet so as to be graspable together by a human hand, said first cushion layer being permanently attached to said woven fabric outer covering by connecting means at an interface between said first cushion layer and said woven fabric outer covering.

2. The cushion assembly of claim 1 wherein said liquid filled pouch is filled with water.

3. The cushion assembly of claim 1 wherein said liquid filled pouch is filled with water and a stabilizing additive.

* * * * *